US006340159B1

(12) United States Patent
Giangrante

(10) Patent No.: US 6,340,159 B1
(45) Date of Patent: Jan. 22, 2002

(54) "DOUBLE CROSS™" GAME SHOW

(76) Inventor: George Giangrante, 228 Kennedy Blvd., Bellmawr, NJ (US) 08031

( * ) Notice: Subject to any disclaimer, the term of this patent is extended or adjusted under 35 U.S.C. 154(b) by 0 days.

(21) Appl. No.: 09/643,745

(22) Filed: Aug. 23, 2000

Related U.S. Application Data

(60) Provisional application No. 60/151,085, filed on Aug. 27, 1999.

(51) Int. Cl.[7] ..... A63F 3/00
(52) U.S. Cl. ..... 273/272; 434/177; 463/40
(58) Field of Search ..... 273/272, 299, 273/153 R; 463/9, 40; 434/177

(56) References Cited

U.S. PATENT DOCUMENTS 3,877,703 A * 4/1975 Pierre
4,106,773 A * 8/1978 Coefield
4,209,173 A * 6/1980 Curtis et al.
4,850,595 A * 7/1989 Sherman et al.
5,566,942 A * 10/1996 Elum
6,120,297 A * 9/2000 Morse, III et al.
6,171,188 B1 * 1/2001 Elstner

OTHER PUBLICATIONS

"Cross Wits", from Net Cross Wits–Rules, wysiwyg://15/http://baugh17.www1.50megs.com/new.rules.html, 1975.*

* cited by examiner

*Primary Examiner*—William M. Pierce
(74) *Attorney, Agent, or Firm*—Irah H. Donner; Hale and Dorr LLP

(57) ABSTRACT

A "Double Cross™" crossword puzzle game is a method of playing a game that allows players to compete to complete a crossword puzzle. The game includes a game board which is configured as a grid of squares with a video screen in the center of the board which can be used to display written or visual clues to help solve the crossword puzzle. The players alternate controlling the selection of clues; when they answer a clue correctly they continue to control the selection, and when they answer incorrectly the clue selection passes to the next player. The game also allows players, having selected a clue, to "double cross" an opponent by challenging that opponent to answer the clue, exposing that opponent to the danger of losing some or all of his accumulated points. The game also includes a final phase where the leading player, or all of the players, must solve a word puzzle consisting of only two interlocking words. The game can be played on a television game show, using telephone or internet communication technologies, as a video game or on a board game.

18 Claims, 15 Drawing Sheets

| | | | | | | | | | | | | | | |
|---|---|---|---|---|---|---|---|---|---|---|---|---|---|---|
| 1 P | 2 I | 3 P | 4 S | | 5 S | 6 A | 7 N | 8 D | | | 9 C | 10 O | 11 B | 12 B |
| 13 L | O | R | E | | 14 C | Z | A | R | 15 S | | 16 A | L | O | E |
| 17 U | N | I | T | | 18 H | A | B | I | T | | 19 W | I | F | E |
| 20 M | I | C | H | 21 A | E | L | | 22 F | A | 23 C | E | O | F | F |
| 24 B | A | Y | | 25 C | D | E | | 26 T | R | O | D | | | |
| | | | 27 A | Q | U | A | | 28 S | E | N | | 29 J | 30 E | 31 D |
| | 32 M | 33 O | G | U | L | | | | | 34 T | 35 H | O | L | E |
| 36 C | A | R | R | I | E | | | | 37 G | R | E | A | S | E |
| 38 A | L | G | A | E | | | | | 39 R | A | D | N | E | R |
| 40 P | L | Y | | 41 S | 42 L | 43 A | | 44 R | E | L | Y | | | |
| | | | 45 I | C | O | N | | 46 A | M | T | | 47 M | 48 P | 49 S |
| 50 P | 51 E | 52 R | F | E | C | T | | 53 B | L | O | 54 W | O | U | T |
| 55 O | V | E | N | | 56 A | L | 57 I | B | I | | 58 A | X | L | E |
| 59 D | I | N | O | | 60 L | E | T | I | N | | 61 L | I | S | A |
| 62 S | L | O | T | | | 63 R | O | T | S | | 64 K | E | E | L |

3d 3c 3b 4a

FIG. 7

SAMPLE CROSSWORD --- QUESTIONS AND ANSWERS

ACROSS

1... GLADYS KNIGHT'S BACK-UP (PIPS)
5... VALENTINO'S BLOOD AND _____ (SAND)
9... TOMMY LEE JONES BIOPIC (COBB)
13. TRADITIONAL TALES (LORE)
14. RUSSIAN RULERS OF YORE (CZARS)
16. BURN AID (ALOE)
17. SAVING PRIVATE RYAN GROUP (UNIT)
18. SISTER ACT COSTUME (HABIT)
19. MELANIE, TO ANTONIO (WIFE)
20. 1996 MOVIE (MICHAEL)
22. 1997 MOVIE (FACE/OFF)
24. WOLFMAN'S NOISE (BAY)
25. THREE AFTER B (C D E)
26. CRUSHED UNDERFOOT (TROD)
27. BLUE HUE (AQUA)
28. D.C. ELECTEE(ABBR) (SEN)
29. BEVERLY HILLBILLIES PATRIARCH (JED)
32. BIZ BIG WIG (MOGUL)
34. PIN THAT HOLDS AN OAR (THOLE)
36. 1976 MOVIE (CARRIE)
37. 1978 MOVIE (GREASE)
38. SEAWEED (ALGAE)
39. WILDER'S "HAUNTED HONEYMOON" CO-STAR (RADNER)
41. ORG. THAT KIDNAPPED PATTY HEARST (S.L.A.)
44. DEPEND (ON) (RELY)
45. P C SYMBOL (ICON)
46. QTY. (AMT)
47. AWOL'S PURSUERS (MP'S)
50. 1985 MOVIE (PERFECT)
53. 1981 MOVIE (BLOW OUT)
55. PIZZERIA FIXTURE (OVEN)
56. TOM SELLECK'S HER ____(1989) (ALIBI)
58. WHEEL SHAFT (AXLE)
59. JERRY'S LONG TIME PARTNER (DINO)
60. ADMIT (LET IN)
61. BONET OF ANGEL HEART (LISA)
62. COIN APERTURE (SLOT)
63. DETERIORATES (ROTS)
64. SEVEN BRIDES FOR SEVEN BROTHERS STAR (KEEL)

FIG. 8A

| FIG. 8A | FIG. 8B |
|---|---|

FIG. 8

SAMPLE CROSSWORD --- QUESTIONS AND ANSWERS (CONT.)

DOWN

1... JAN BRADY'S TV PRODUCER (PLUMB)
2... REGION OF ASIA MINOR (IONIA)
3... EXPENSIVE (PRICY)
4... BROTHER OF CAIN AND ABLE (SETH)
5... TIMETABLE (SCHEDULE)
6... RHODODENDRON'S KIN (AZALEA)
7... APPREHEND (NAB)
8... WIND BORNE SNOWBANKS (DRIFTS)
9... MADE CROW SOUNDS (CAWED)
10. HODGEPODGE (OLIO)
11. SMASH HIT, IN VARIETY (BOFF)
12. NO-NO FOR VEGETARIANS (BEEF)
15. STEADY LOOK (STARE)
21. GIVE IN (ACQUIESCE)
23. LOWEST FEMALE SINGING VOICE (CONTRALTO)
27. TAJ MAHAL CITY (AGRA)
29. MOMMIE DEAREST ROLE (JOAN)
30. OTHERWISE (IF NOT)
31. THE ___ HUNTER (DEER)
32. WOODY ALLEN'S SCENES FROM A ___ (MALL)
33. CALIGULA EVENT (ORGY)
35. LAMARR OF ALGIERS (HEDY)
36. PART OF SHERLOCK COSTUME (CAP)
37. GIZMO'S ILK (GREMLINS)
42. 1983 MOVIE, _____ HERO (LOCAL)
43. ONE OF BULLWINKLE'S PAIR (ANTLER)
44. EDDIE VALIENT'S CLIENT WAS ONE (RABBIT)
45. OTHERWISE (IF NOT)
47. CHUTZPAH (MOXIE)
48. ARTERIAL THROBBING (PULSE)
49. CAGNEY'S NEVER __ ANYTHING SMALL (STEAL)
50. INVASION OF THE BODY SNATCHERS VESSELS (PODS)
51. WELLS' TOUCH OF ___ (1966) (EVIL)
52. NEVADA CITY (RENO)
54. CARY GRANT'S _____, DON'T RUN (1966) (WALK)
57. NEWS MAKING JUDGE (ITO)

FIG. 8B

"DOUBLE CROSS™" GAME SHOW

RELATED APPLICATIONS

This application claims priority from provisional patent application App. No. 60/151,085, filed Aug. 27, 1999.

FIELD OF INVENTION

The present invention relates generally to games, and more particularly, to a crossword puzzle game show. Players may also hook into the central game show through the internet. New rules and elements are added to the crossword puzzle game show to enhance the play.

BACKGROUND OF THE INVENTION

Over the years there have been many word games that test the player's knowledge and vocabulary skills. From "quiz shows" to board games like Trivial Pursuit™, many of these word games test the player's knowledge against other players' knowledge. The standard crossword puzzle, on the other hand, is not played competitively but rather involves one player testing his knowledge and skill in solitude. Everyone is familiar with the crossword puzzle. It consists of a grid of small squares, each of which squares is either blacked out or is empty and must be filled with a letter. Each horizontal or vertical sequence of empty squares, delimited by either a blacked-out square or the edge of the grid, must be filled with a word. A separate list of clues gives the player hints as to the appropriate word to be filled in for each sequence of empty squares. Because the horizontal words and the vertical words intersect with each other and thus have certain letters in common, the player may also get a hint of the appropriate word from the letters that are already filled in. Of course, if the player fills in one word incorrectly, she may be led astray as she tries to complete other words that share letters in common with her incorrect guess.

Crossword puzzles first appeared in *The New York Times* on Feb. 15, 1942, and became an instant hit. A 1959 Gallup poll named crossword puzzles the number one pastime in the United States, with millions of people of all ages playing every day.

It is estimated that there are now over 50 million devotees of crossword puzzles in the United States, and many millions more toil over them in other countries. According to Will Schortz, crossword puzzle editor of *The New York Times*, "these brain teasers arc found in all languages, and in newspapers around the world."

In the United States alone, there are approximately 1,509 daily newspapers (with a circulation of over 56.7 million), and 903 Sunday papers, (with a circulation of over 60.5 million), and there is a crossword puzzle in every one of these newspapers. Also, consider these facts:

- There are currently 121 internet sites devoted to crossword puzzles, as well as, crossword puzzle software.
- It is said that many people buy their paper just for the crossword puzzles.
- There are national and international crossword puzzle tournaments.
- There is a Crossword Puzzlers Association, located in New York City.

Crossword puzzles have been a hit since *The New York Times* published its first crossword puzzle in 1942. Because of their popularity, various efforts have been made to create new games based on the crossword puzzle concept or to create new ways of playing. Examples of such efforts are described in the following U.S. patent references, all of which are hereby incorporated by reference:

U.S. Pat. No. 6,062,978, to Martino, et al., describes a rotating cube displayed three-dimensionally on a computer, on which crossword puzzle or other games can be played (see FIG. 15). U.S. Pat. No. 5,566,942, to Elum, relates to a crossword-puzzle type game where indicia on specific squares give added hints to help solve the puzzle. U.S. Pat. No. 4,299,578, to Wayman, discloses a method for generating a crossword puzzle as well as automatically searching for solutions.

U.S. Pat. No. 4,850,595, to Sherman, et al., relates to a crossword puzzle game that involves elements of skill and chance. The game is played with a die, each of whose sides shows a number, either 4–, 5, 6, 7, 8+ or "wild." On each player's turn, he must roll the die and then he must attempt to complete a word with the same number of letters as is shown on the die. For a "wild" roll, the player may choose any length word. Points are accumulated by adding one point for each letter of a correctly filled in word. A player may also challenge an opponent's answer by referring to an answer key. If the challenged answer is correct, the opponent keeps the points and the challenger loses a turn. If the challenged answer is incorrect, the challenger gets the points and the opponent may lose a turn.

U.S. Pat. No. 4,209,173, to Curtis, et al., relates to crossword puzzle game equipment for playing a crossword puzzle board game. The game board includes a grid of consecutively numbered squares, some of which must be blacked out before each game in order to form a crossword puzzle surface. The equipment includes multiple clue books, each containing multiple crossword puzzles. Each player may look at his own clue book as players simultaneously attempt to solve the crossword puzzle.

U.S. Pat. No. 4,179,126, to Coefield, relates to a competitive crossword puzzle game. Players take turns filling in the crossword puzzle. Each player uses a different colored marker to fill in the squares of the puzzle grid, each of which squares is assigned a numerical value. The length of time that a player may use for each turn is limited by a timer. When the puzzle is complete, the score for each player is the sum of the numerical values assigned to the squares that are filled in with the color of that player's marker.

U.S. Pat. No. 4,171,815, to Sturtz, relates to a word game that is played on a game board. The game board allows for the insertion of different crossword puzzles onto the surface of the board. Opponents take turns filling in one letter of the crossword puzzle at a time. For each letter inserted, a certain number of points is added to the player's score, corresponding to the sum of the number of the row in which the letter was inserted, the number of the column in which the letter was inserted, and the number of bonus points associated with the letter that was used. Players also lose a certain number of points for inserting each wrong letter.

Unfortunately, all of the prior art lacks the combination of challenging, exciting, and competitive elements to the game. The standard crossword puzzle is normally played individually by a student taking a study break, a commuter trying to ignore the crush of rush hour, or by someone curled up on their couch, relaxing in the comfort of their own home. Indeed, the goal of the standard crossword puzzle is often to help the player relax. The standard crossword puzzle thus lacks the excitement of a competitive game, and is designed generally in the opposite manner.

Most crossword puzzle games also lack a buildup of excitement until a certain climax, where all of or a portion of that which a player has won earlier in the game may be lost, and a player who has been losing up to that point may increase their score by up to double the previous amount and/or all of a sudden emerge victorious.

Another element lacking in most game shows is a component that allows the audience watching the game from home to participate actively in the game, rather than to observe passively. Most games and/or game shows also lack the element of a live broadcast, thereby detracting from the show's excitement.

Accordingly, it is desirable to create a new crossword puzzle game that will continue to challenge the players' skills, and that will add elements to the game that will make the game more exciting and dramatic.

It is also desirable to create a new version of the crossword puzzle game that adds competitive elements to the game, by allowing multiple players to compete against each other, rather than playing in solitude or cooperatively with other players.

It is further desirable to allow multiple players to challenge each other directly and take each other's winnings, rather than merely to compete indirectly for the highest score, increasing the competitiveness and excitement of the game.

It is further desirable to add a climactic phase to the crossword puzzle game, where everything that a player won earlier in the game may be lost, and where a player who has been losing up to the point may all of a sudden emerge victorious.

It is also desirable to create a new crossword puzzle game show that will allow those watching from home to interact with the show and to participate in the game. It is further desirable to create a new game show that will be shown live, adding to the drama of the show.

SUMMARY OF THE INVENTION

It is a feature and advantage of the present invention to challenge the players' skills, as well as add elements to the crossword puzzle game that will make the game more exciting and dramatic.

It is another feature and advantage of the present invention to provide competitive elements to the game, by allowing multiple players to compete against each other, rather than playing in solitude or cooperatively with other players.

It is another feature and advantage of the present invention to optionally have multiple players to challenge each other directly and optionally take each other's winnings, rather than merely to compete indirectly for the highest score, increasing the competitiveness and excitement of the game.

It is a further feature and advantage of the present invention to optionally include a climactic phase of the game, where everything or a portion thereof that a player won earlier in the game may be lost and/or further increased, and where a player who has been losing up until that phase may all of a sudden emerge victorious, adding to the drama and excitement of the game.

It is a further feature and advantage of the present invention to optionally allow those watching the game show from home to interact with the show and to participate in the game. It is another feature and advantage that the game show will be shown live, adding to the drama of the show.

To achieve the features and advantages of the present invention, a method of playing a game allows players to guess words and/or letters that form part of the solution to a crossword puzzle, after receiving a clue about the word used to fill that space. For each word or letter guessed correctly, a player adds a certain number of points to his total score, depending on the number of letters contained in the relevant word. When taking his turn, a player also has the option to "double cross" an opponent, forcing that opponent to guess the word or letter. If the challenged opponent guesses correctly he earns the value of the relevant word or letter, multiplied by an increased factor. If the opponent guesses incorrectly he loses the value of the word or letter.

The game method also optionally includes a climactic final phase, involving guessing the solution of a puzzle that consists of two intersecting words. The player in the lead must guess, for example, the first word or portion thereof correctly, otherwise she loses completely or loses some points. If she guesses correctly, she adds a certain amount to her score or wins a bonus award. She then has the option either to guess the second word, thereby adding even more to her final score if she guesses correctly, but risking a total or partial loss, or to "pass" on the second word, achieving a lower final score but ensuring her own victory or increased score.

In another embodiment of the invention, a method of playing the Double Cross™ Game Show by interacting from home is provided. By using an optional Internet link to the central game show office or by calling in over the telephone or other communication link, members of the home audience may have their own solutions to the featured puzzles scored by the central game show office. Home players with the highest scores could then be recognized on the live game show or could receive small prizes for participating.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

The above objects of the invention, together with other apparent objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF DRAWINGS

FIG. 7 is an illustration of a Double Cross™ game board with a completed puzzle solution.

FIG. 8 shows the clue set that corresponds to the puzzle solution shown in FIG. 7.

DETAILED DESCRIPTION OF INVENTION

Reference now will be made in detail to the presently preferred embodiments of the invention. Such embodiments are provided by way of explanation of the invention, which is not intended to be limited thereto. In fact, those of ordinary skill in the art may appreciate upon reading the present specification and viewing the present drawings that various modifications and variations can be made.

For example, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

The following describes the basic components and rules for playing the Double Cross™ Game Show game.

Figure 1:
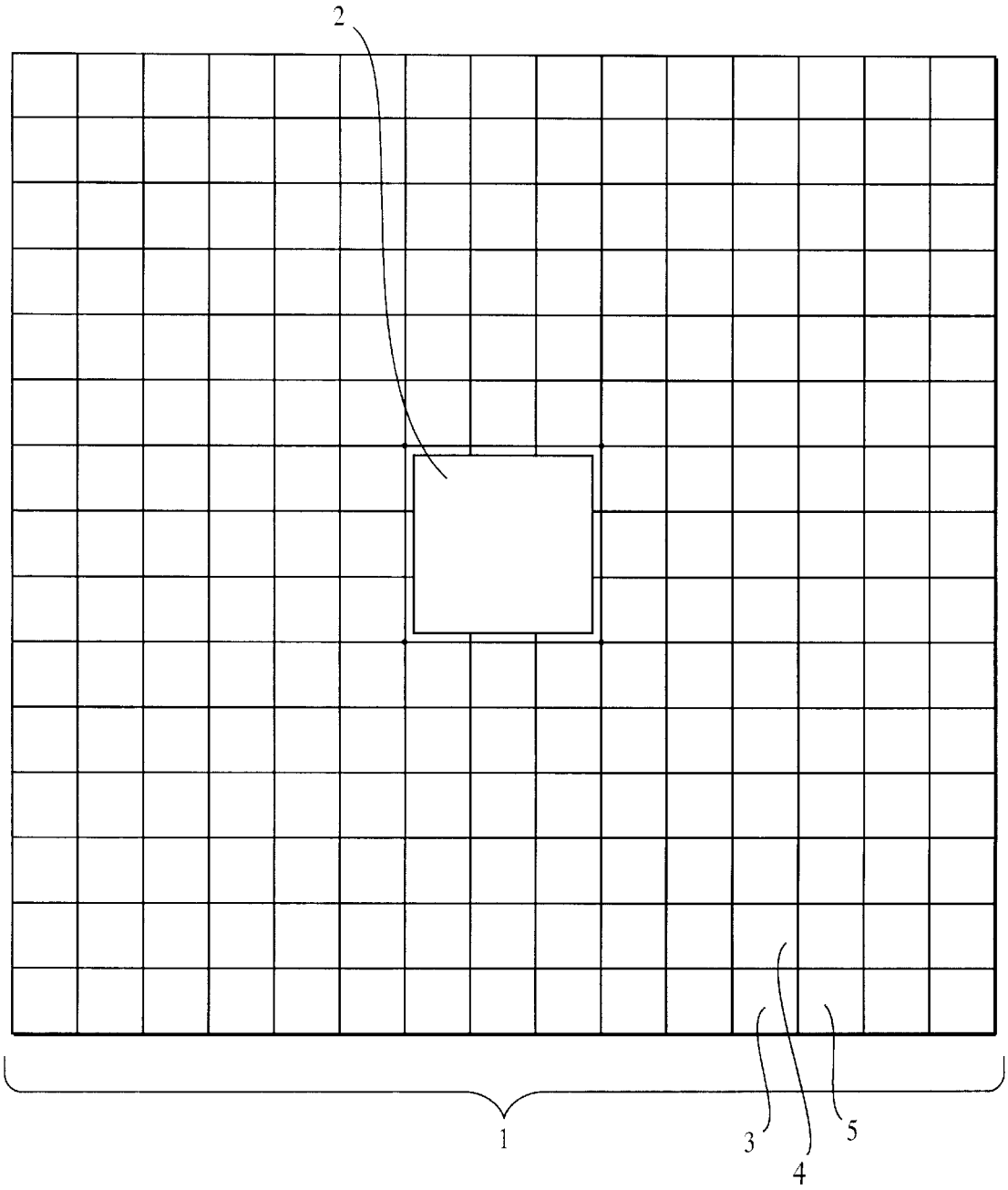
FIG. 1 is an illustration of the standard game board configuration for the Double Cross™ Game Show.

The game board consists of a grid of squares or other shapes, for example, a 15-by-15 grid of squares or other shapes or other suitable number of squares or other shapes. Note that the grid of squares may be of any suitable shape, such as a circle, rectangle, pentagon, octagon, or any polygon. FIG. 1 shows a preferred embodiment of the electronic puzzle game board 1 designed in a grid format that will contain, for example, approximately 225 standard back lit squares 3,4,5 (for example, 15 across and 15 down, depending on the size of the puzzle).

Figure 2:
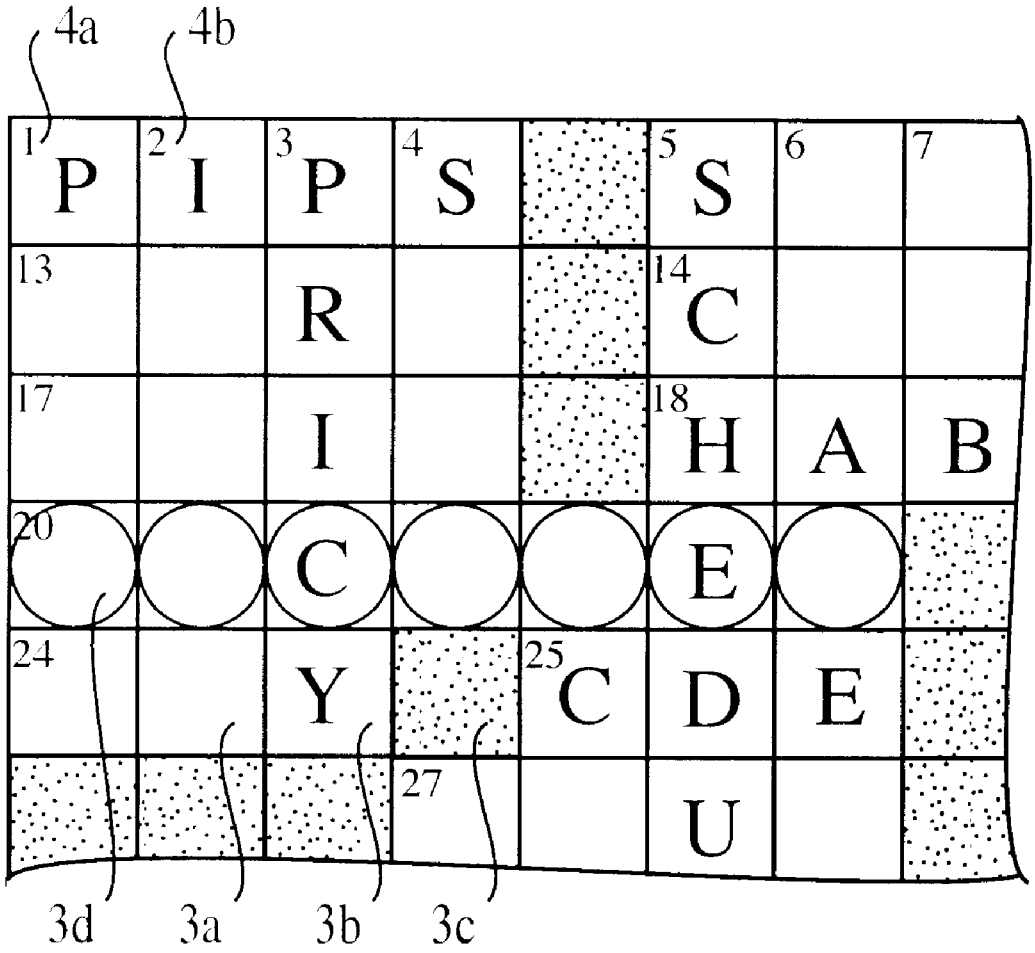
FIG. 2 is a close-up on a section of the standard game board, showing the different functionalities of the game board's squares.

See FIG. 2 for a close-up view of a corner section of the game board. Each square 3*a*–3*d* will have the ability, as shown in FIG. 2, optionally to:

1) display one of the letters from "A" to "Z" 3*b;*
2) display the "across", "down", and "up" numbers 4*a*, 4*b*, or any other identifying symbol such as a letter, to mark the beginning of the word that solves the clue with the corresponding number or letter;
3) be blacked-out to create a "black square" 3*c* where necessary to delimit word solutions;
4) be lighted sequentially with other squares that will hold the letters forming a word, when the clue corresponding to the word solution for those squares is selected by a contestant.
5) contain special markings, for example, a different color background or a circular frame within the square 3*d*, indicating that the word of which the letter to be held within the square is a part is a solution to a special type of clue, for example, a video clue.

The game board can be a large video display in a television studio where the game show is being taped. Alternatively, the game board can be out of cardboard and of a size to sit on a table top, to be used by a group of players at home. Alternatively, the game board can be displayed electronically on a computer monitor, a lighted square or other shape, or any other electronic display device, users playing against one another using the internet or some other electronic connection between players, such as a multi-station video game.

Figure 3:
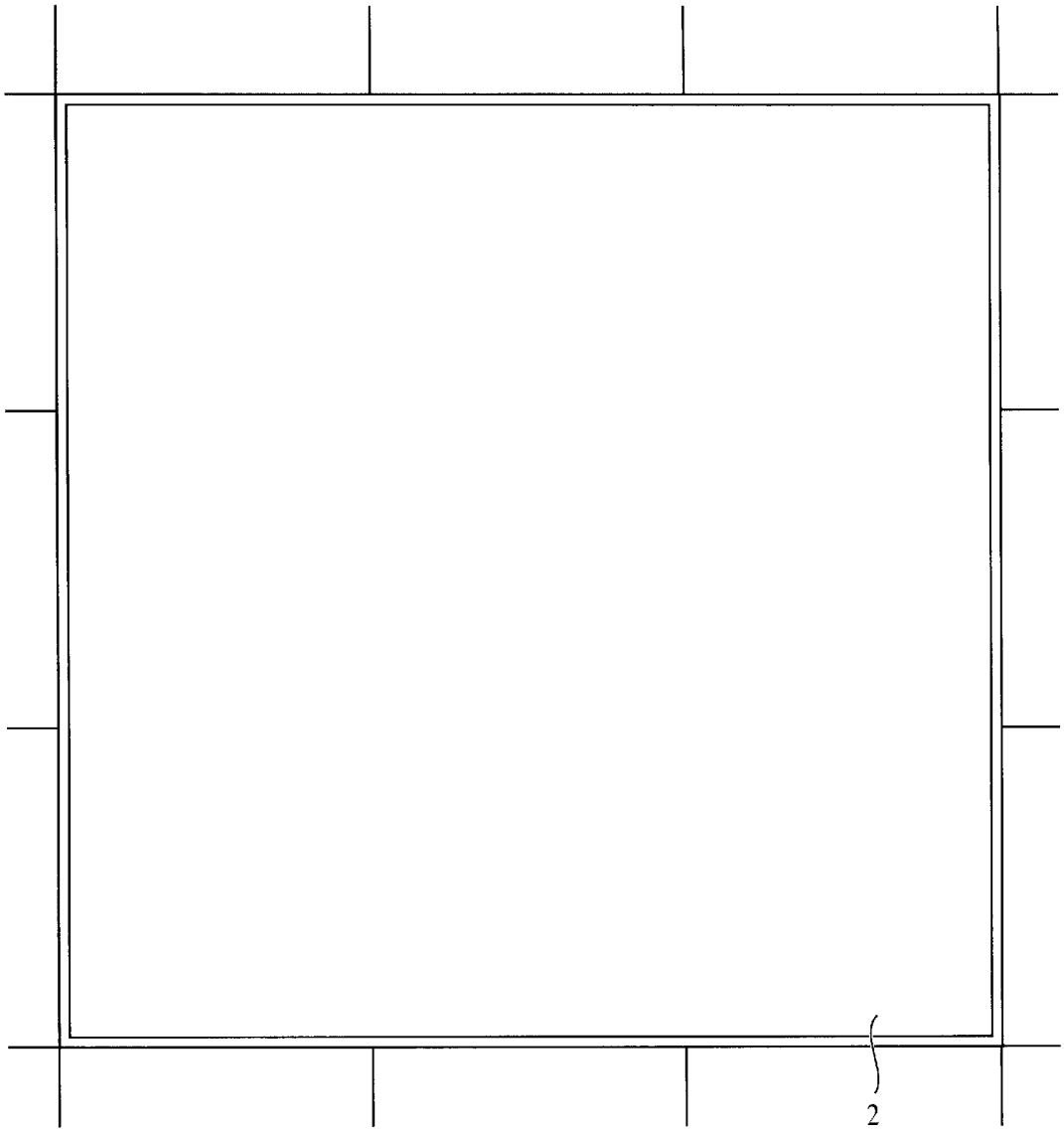
FIG. 3 is a close-up on the video screen in the center of the standard game board.

FIG. 1 also shows that in the center of the grid 1 is located a video screen 2 of any suitable shape. See FIG. 3 for a close-up view of the screen. This video screen will be used to display the "Video Clues", such as video clips or still photos. Video clues are clues that, rather than consisting simply of a verbal clue, have a visual element. In the game board embodiment of this invention, the video clues may refer the player to special cards displaying prints of still photographs.

Figure 10:
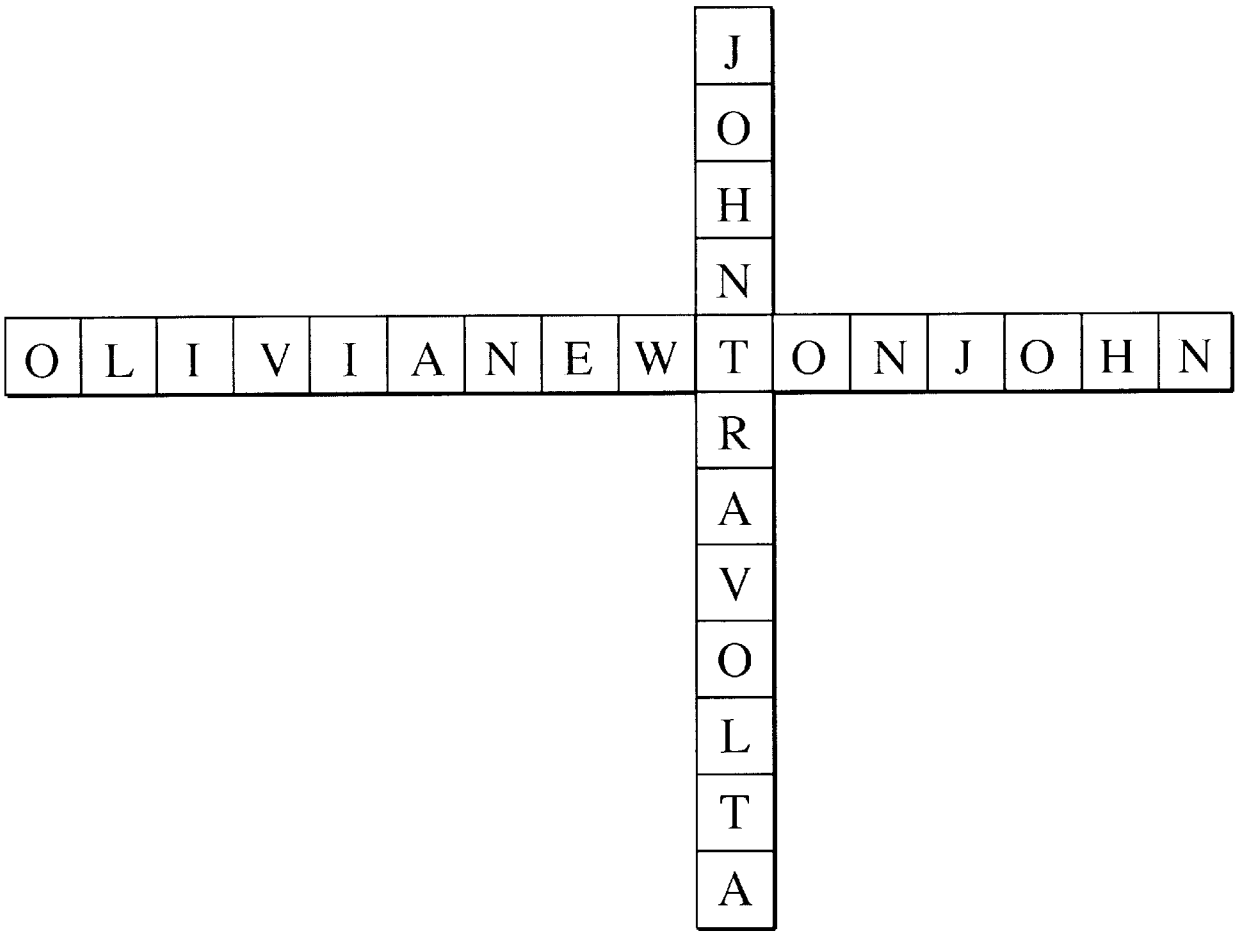
FIG. 10 is an illustration of the "Ultimate Double Cross™" board layout, including a solution.

Other configurations of the video screen may be used. For example, it may display the written clue currently being guessed, the logo of the game show, indicate the phase of the game, or hold the special two-intersecting-word puzzle (see FIG. 10) that is solved in the final phase of the Double Cross™ game.

Figure 4:
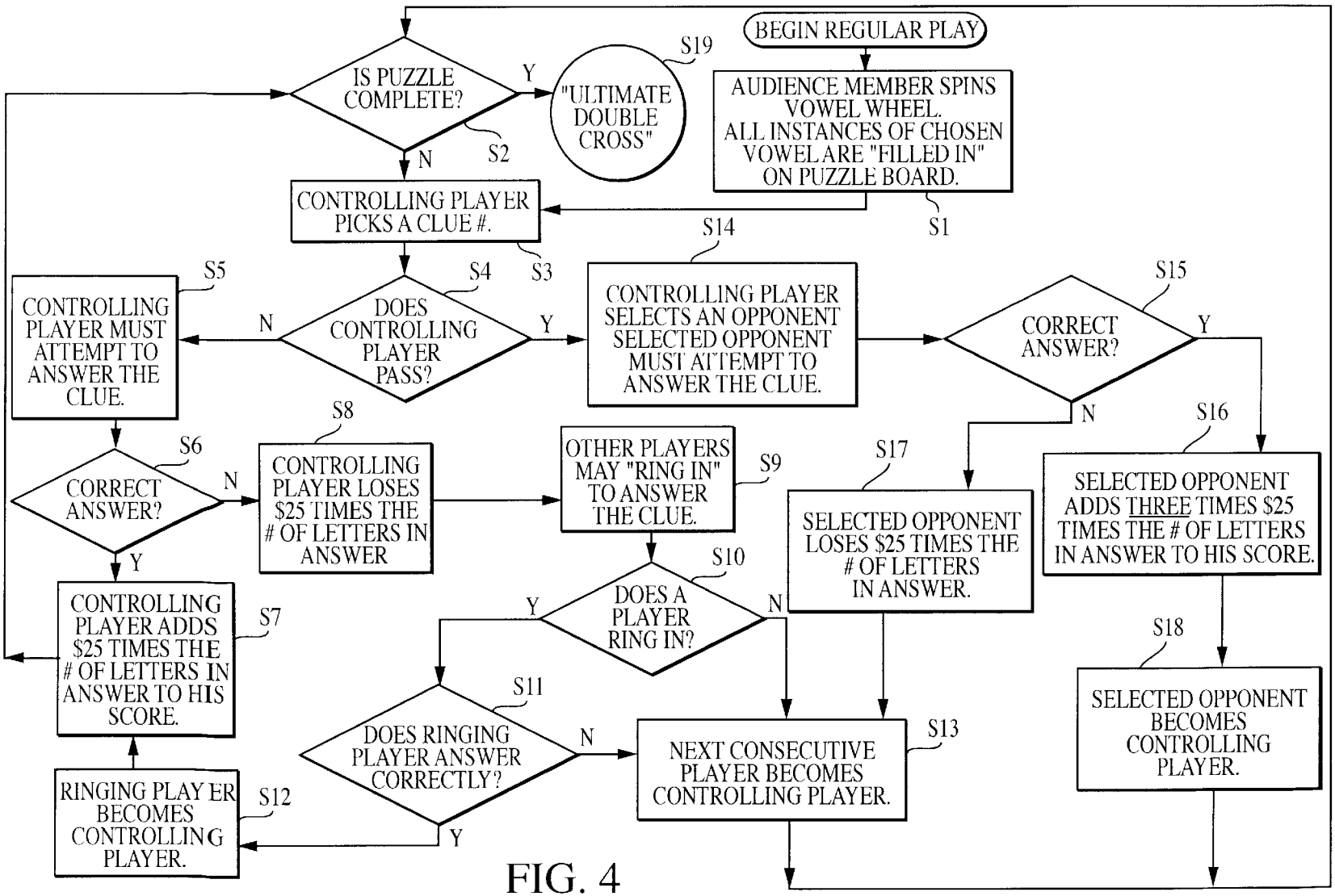
FIG. 4 is a flowchart of the Double Cross™ Game Show.
Figure 5:
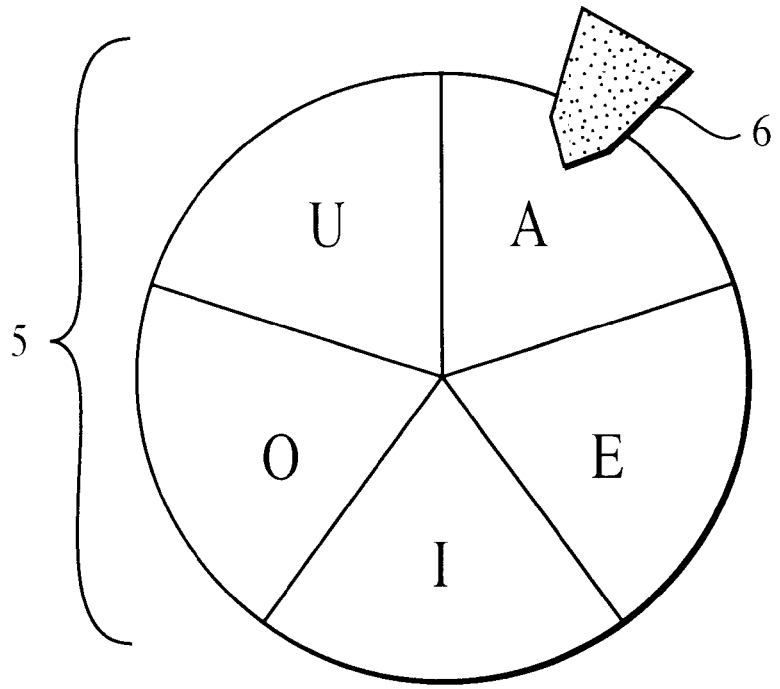
FIG. 5 is an illustration of the vowel wheel used to determine playing priority in the Double Cross™ Game Show.

FIG. 4 shows a flowchart of the general rules and process of a preferred embodiment of the game invention. The game show begins with the spin of a vowel wheel 5 (see FIG. 5) by an audience member, so that the vowel wheel 5 pointer 6 ends up pointing to a certain vowel. All occurrences of the resulting vowel within the crossword puzzle grid are then filled in s1.

Alternatively, the game can begin and/or be played by any other method of choosing a particular letter and filling in all occurrences of that letter within the crossword puzzle grid. Another option is to begin the play by selecting a particular vowel or any other letter or group of letters, and filling in a limited number of occurrences of those letters within the puzzle grid. The object of beginning the play in this way is that the players will have a hint of part of the correct solution as they begin the game. This object can be accomplished in a number of ways, not to be limited by the foregoing options, which represent examples of means to achieve this object. Alternatively, the players can begin play without receiving any hint as to part of the correct solution to the puzzle.

Figure 6:
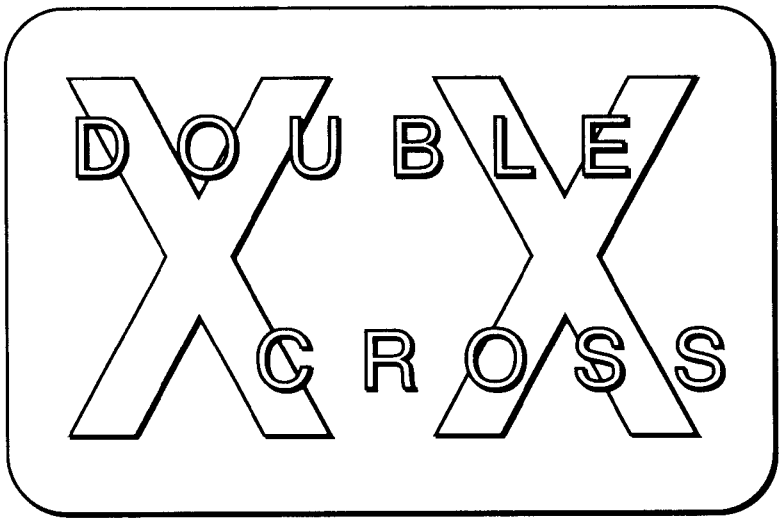
FIG. 6 is an illustration of the "Double Cross™" game card.

Once the game begins, players take turns controlling the selection of clues to be solved. In the preferred embodiment, 3 players will play the game, although any number of players may participate. As shown in FIG. 4, the controlling player picks a clue number from the list of clues that have not yet been chosen s3. At this point the player makes a critical decision. He must either attempt to answer the clue himself, or he "double crosses" an opponent by challenging the opponent to attempt to answer the clue s4. Each player may be given only one chance to "double cross" an opponent during the game, by playing his "Double Cross™" card, shown in FIG. 6. Alternatively, players may be allowed to "double cross" opponents a certain number of times, or an unlimited number of times, and/or players are provided clues randomly.

If the player chooses to attempt to answer the clue himself s5, and he answers correctly s6, a certain number of dollars or points is added to his score s7, and the player may select the next clue s3. For example, a number of dollars equaling 25 times the number of letters in the correctly guessed answer may be added to his score s7. If the player chooses to attempt to answer the clue himself s5, and he answers incorrectly s6, the player either adds nothing to his score or loses a certain number of points or dollars from his score. For example, a number of dollars equaling 25 times the number of letters in the attempted answer may be subtracted from his score s8. The player also loses the chance to choose the next clue.

Optionally, after an incorrect answer, other contestants may be given the chance to attempt to answer the chosen clue by "ringing in" s9. It is also optional that players be given only a limited amount of time to answer a clue, before other players are given the opportunity to ring in. Another option is that all players compete to ring in the answer to the chosen clue. Under this option, the only advantage gained by being the player who chooses the clue is that that player may strategically choose a clue that he thinks he can solve but with which others may have difficulty, thereby racking up points early on in the game.

If a player decides not to attempt to answer a clue himself s4, but instead to "double cross" an opponent, then the opponent attempts to answer the clue s14. If the challenged player answers the clue correctly s15, a certain number of dollars or points is added to his score. For example, a number of dollars equaling 75 times the number of letters in the correctly guessed answer may be added to his score s16. Alternatively, the challenged player may take and add to his own score all of the points from the challenging player. However, if the challenged player answers incorrectly, he either adds nothing to his score or loses a certain number of points or dollars from his score. For example, a number of dollars equaling 25 times the number of letters in the attempted answer may be subtracted from his score s17. Optionally, the player who "double crossed" may add a certain number of points to his own score by virtue of having successfully double-crossed an opponent, or, the player who "double crossed" may take and keep all of the challenged player's points or money.

This process of selecting a clue s3 and then choosing s4 between attempting to answer the clue s5 or double-crossing an opponent s14 continues until the crossword puzzle has been filled in completely and correctly s2. See FIG. 7 for an example of a crossword puzzle that has been correctly and completely filled in, according to the corresponding clues shown in FIG. 8.

The final phase of a crossword puzzle game show occurs once the initial crossword puzzle has been completely filled in. The final phase can be called "Ultimate Double Cross™" or "Final Double Cross™" or any name conveying its character as the decisive final stage of the game.

Figure 9:
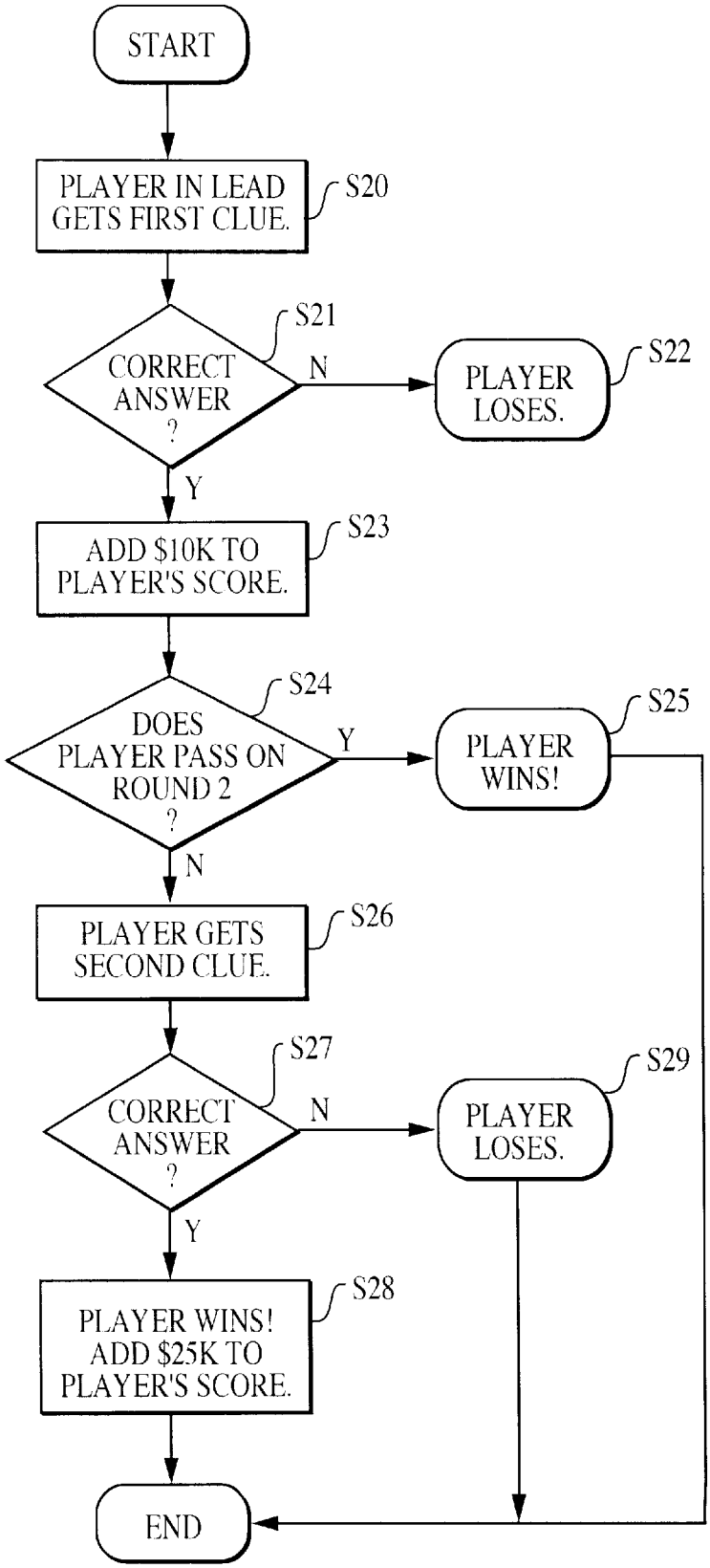
FIG. 9 is a flowchart for the "Ultimate Double cross™" phase of the Double Cross™ Game Show.

FIG. 9 shows a flowchart for the rules and process of a first preferred embodiment of the final phase of the Double Cross™ game show. In this embodiment, only the player with the highest score at the end of the regular round of play enters the final phase of play. This player gets the clue for the first word of the two intersecting words that form the final Double Cross™ board s1. (See FIG. 10 for an illustration of the final Double Cross™ board.) If she answers incorrectly s21, the player loses s22. If she answers correctly s21, she adds a certain number of points or dollars to her score, for example, ten thousand dollars s23. She then has the chance to play or pass on the second round s24. If she passes, she wins the game with her current score s25. If she decides to play, she gets the second clue and attempts to answer s26. If she answers correctly, she wins the game, this time adding even more points or dollars to her final score, for example, twenty-five thousand dollars s28. If she answers incorrectly, she loses s29. An additional option if she answers incorrectly is that another player who has been kept in isolation during the final phase, without having heard the clues, may attempt to solve the final Double Cross™ puzzle.

Figure 11:
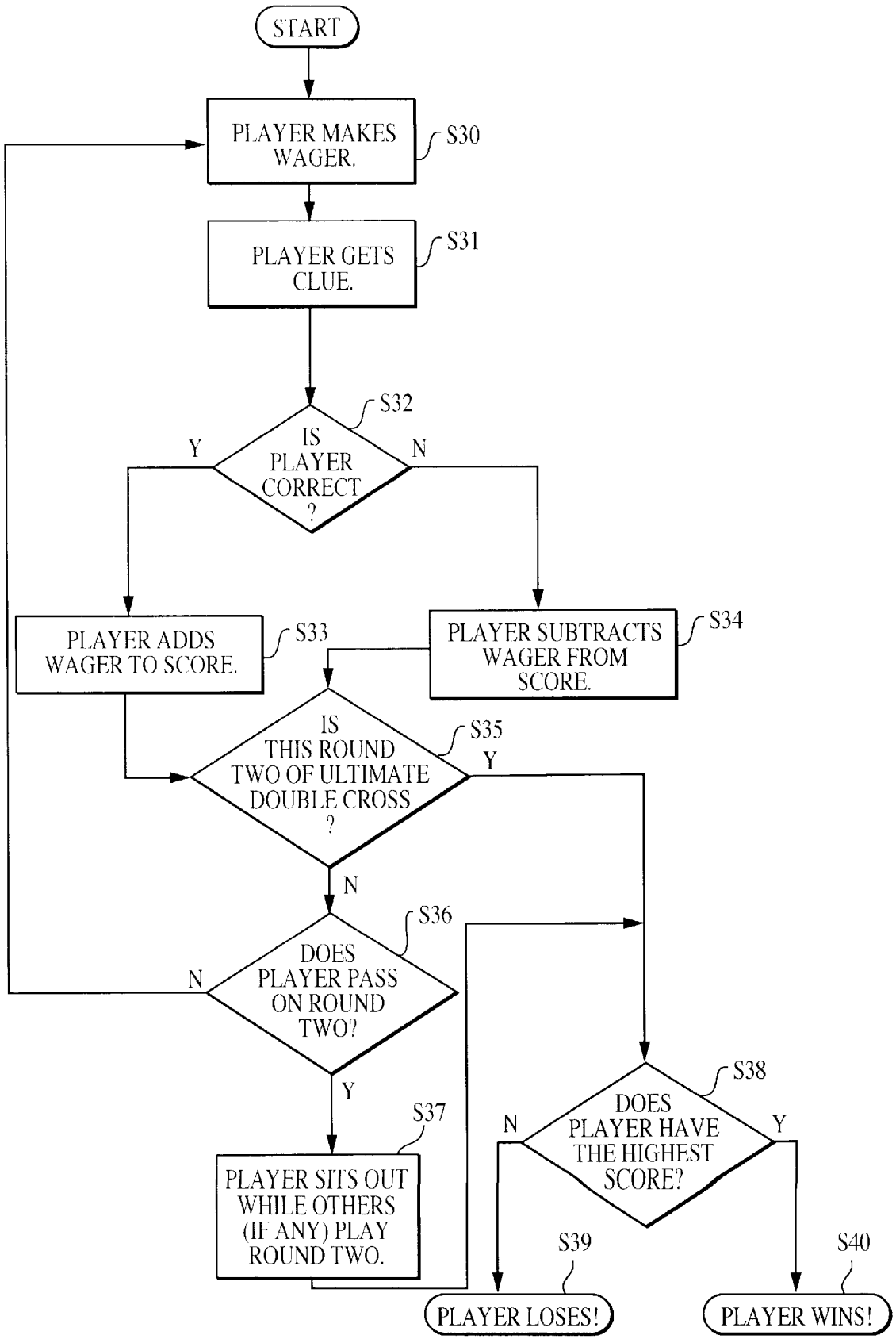
FIG. 11 is a flowchart for an alternate version of the "Ultimate Double Cross™" phase of the Double Cross™ Game Show.

FIG. 11 shows a flowchart of the rules and process for a second preferred embodiment of the final phase of the Double Cross™ game show. In this embodiment, all players enter the final phase of the Double Cross™ game. Before receiving the clue for the first word of the two intersecting words that form the final Double Cross™ board s31, each player must wager a certain number of points from his own score s30. If a player is correct s32, he adds his wager to his score s33. If a player is incorrect, he subtracts his wager from his score s34. Before receiving the clue for the second word s31, each player may again wager a certain number of points from his own score s30, or a player may choose s36 to wager nothing at all by passing on round two of the final phase s37. If a player answers the second clue correctly he adds his wager to his score s33. If a player is incorrect, he subtracts his wager from his score s34. The player with the highest score s38 at the end of this final phase wins the game s40. For example, he may win the dollar amount of his own score. Optionally, he may win a set dollar amount such as one hundred thousand dollars, or the player's score is not reduced with an incorrect answer.

Figure 12:
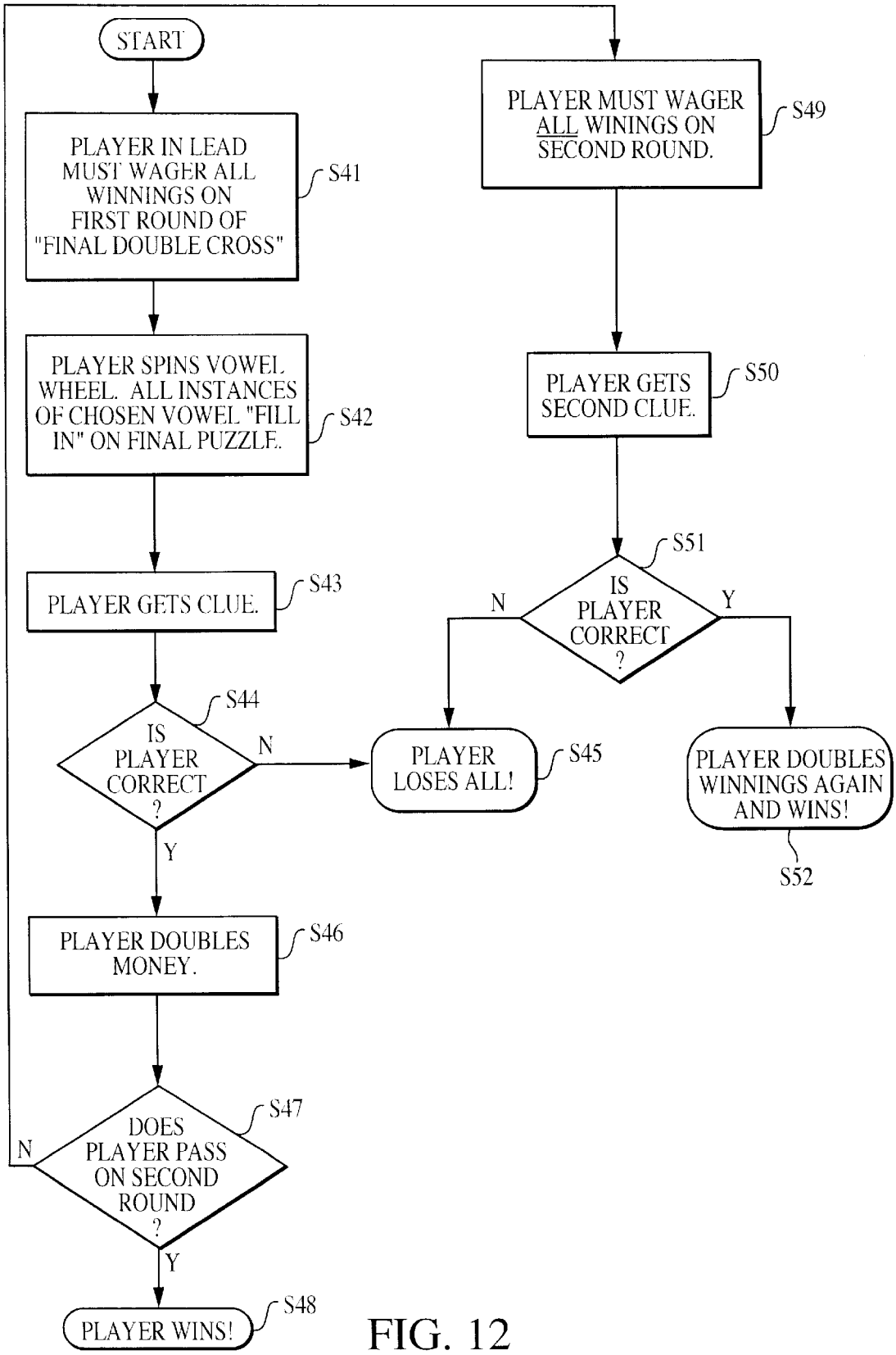
FIG. 12 is a flowchart for a second alternate version of the "Ultimate Double Cross™" phase of the Double Cross™ Game Show.

FIG. 12 is a flowchart of a third preferred embodiment of the final phase of the Double Cross™ game show. In this embodiment, the player with the highest score at the end of the regular phase of play must stake all of her winnings on the first round of "Final Double Cross™" s41. She spins the vowel wheel (see FIG. 5), and all instances of the resulting vowel fill in on the final puzzle s42. The player gets the first clue s43, and if answered incorrectly s44, she loses the game with no winnings s45. However, if answered correctly s44, she doubles her score s46, and then has the option to either play or pass on the second round of "Final Double Cross™" s47. That is, she may win with her current score s48, or she may once again stake all of her winnings s49. If she plays round two and answers incorrectly s51, she loses the game with no winnings s45. However, if she answers round two correctly, she doubles her score once again and wins s52!

Figure 13:
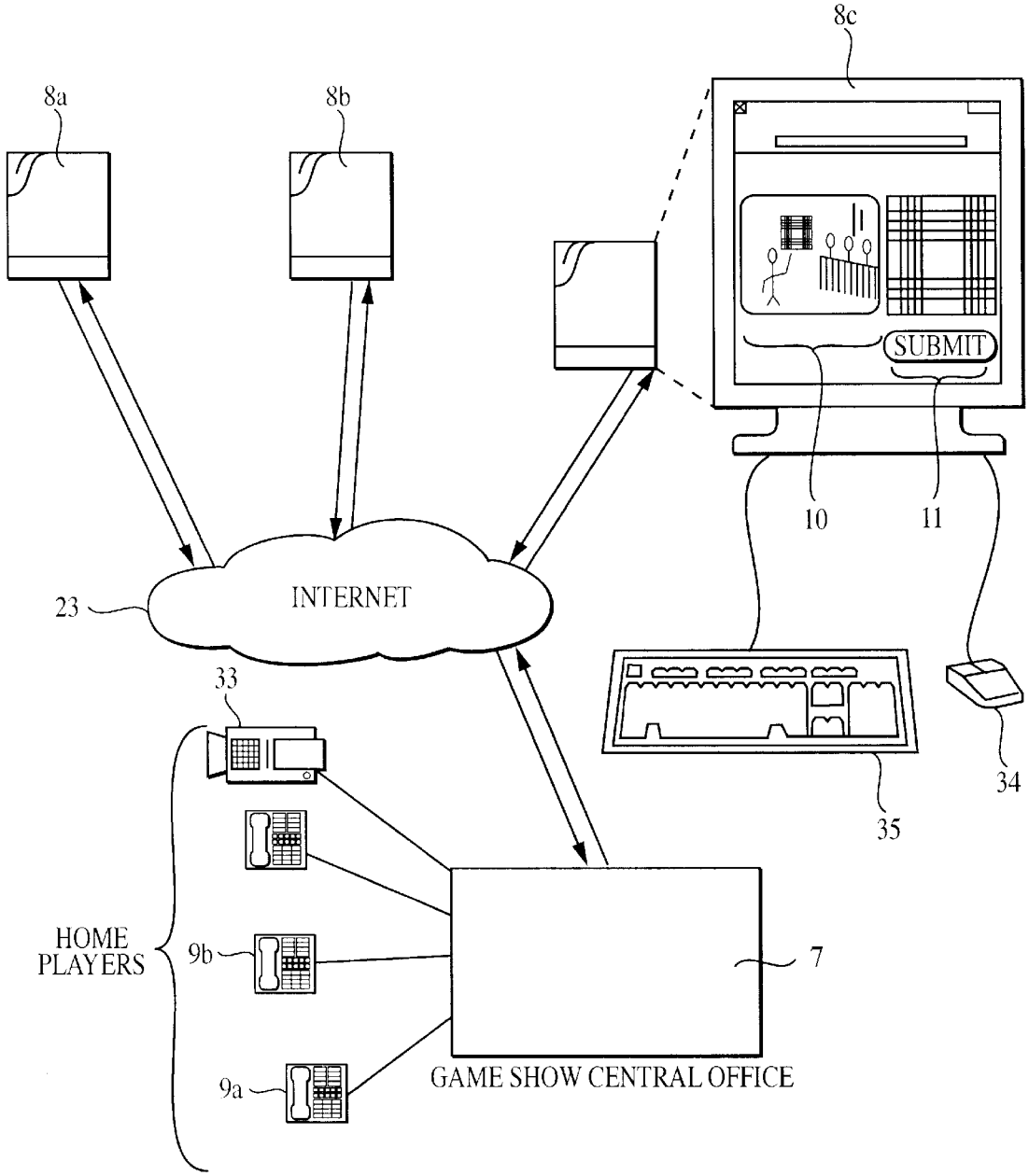
FIG. 13 is a diagram of the required network connections for the option to play the game show from home.

FIG. 13 is a diagram of how of how members outside of the game show studio can play Double Cross™, in alternate embodiments of the invention. Players can verbally call in solutions to the game show puzzles over the telephone 9*a*, 9*b*, or they can use a facsimile machine 33 to fax their answers to the game show's central office 7.

In another alternative embodiment, players can play along on their standard home computers or televisions 8*a*–8*c* simultaneously with the game show being shown live on television, on special software, licenses for which would be obtained from the game show. (The software could also be downloaded from the game show's website.) Then, using the Internet 23, 24 to interact with the game show central office 7, the home player could play along on his own screen. For example, the home player's screen 8*c* could be divided into two sections. One section would show the live game show 10, so that the home player could see and hear the clues live from the game show studio. The other section of the screen would show the player's personal game board 11 where the player can fill in the letters on the puzzle using his computer's 8*c* mouse 34 and keyboard 35.

All of these home players could compete with each other to complete the puzzle most accurately and quickly. For example, the total amount of time taken by each player to solve each clue would be added up to find their game "speed," with a large time penalty taken for each clue that was not solved before the correct answer was revealed on the live game show.

Figure 14:
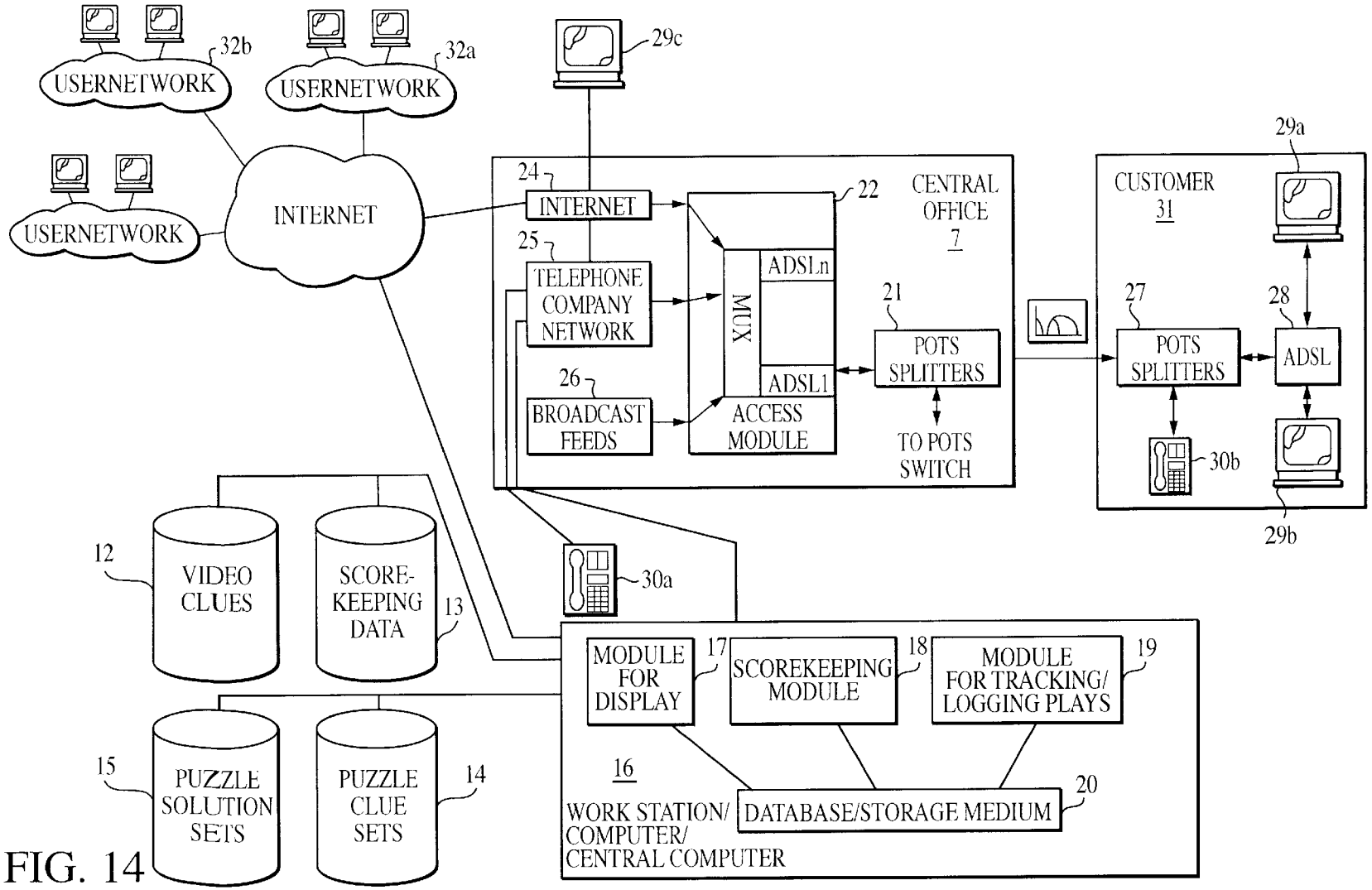
FIG. 14 is an illustration of the architecture of the combined internet, POTS, and ADSL architecture for use in the present invention in accordance with an alternate embodiment.
Figure 15:
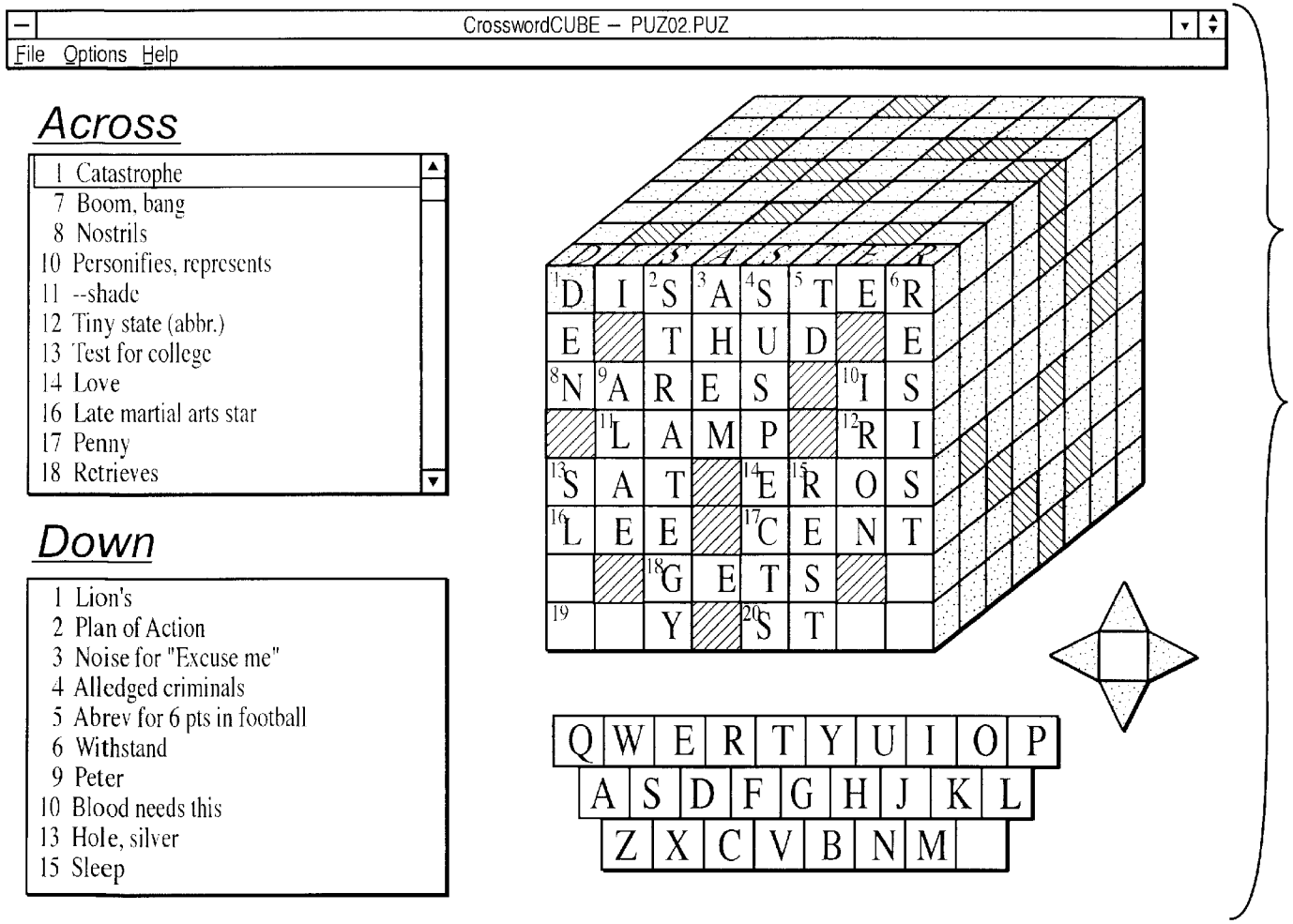
FIG. 15 PRIOR ART
FIG. 15 is an illustration of the electronically displayed game board in a prior art rotating cube game puzzle.

FIG. 14 is an illustration of the architecture of the combined internet, POTS, and ADSL architecture for use in the present invention, for home players who are playing over the internet. In FIG. 14, to preserve POTS and to prevent a fault in the ADSL equipment 22, 28 from compromising analog voice traffic 30*a*, 30*b*, the voice part of the spectrum (the lowest 4 kHz) is separated from the rest by a passive filter, called a POTS splitter 21, 27. The rest of the available bandwidth—from about 10 kHz to 1 MHz—carries data at rates up to 6 bits per second for every hertz of bandwidth from data equipment 29*a*–29*c*. The ADSL equipment 22 then has access to a number of destinations including significantly the Internet 24, and other destinations 25, 26.

To exploit the higher frequencies, ADSL makes use of advanced modulation techniques, of which the best known is the discrete multitone (DMT) technology. As its name implies, ADSL transmits data asymmetrically—at different rates upstream toward the central office 7 and downstream toward the subscriber 31.

Cable television providers are providing analogous Internet service to PC users over their TV cable systems by means of special cable modems. Such modems are capable of transmitting up to 30 Mb/s over hybrid fiber/coax systems, which use fiber to bring signals to a neighborhood and coax to distribute it to individual subscribers.

Cable modems come in many forms. Most create a downstream data stream out of one of the 6-MHz TV channels that occupy spectrum above 50 MHz (and more likely 550 MHz) and carve an upstream channel out of the 5–50-MHz band, which is currently unused. Using 64-state quadrature amplitude modulation (64 QAM), a downstream channel can realistically transmit about 30 Mb/s (the oft-quoted lower speed of 10 Mb/s refers to PC rates associated with Ethernet connections). Upstream rates differ considerably from vendor to vendor, but good hybrid fiber/coax systems can deliver upstream speeds of a few megabits per second. Thus, like ADSL, cable modems transmit much more information downstream than upstream.

The internet architecture 23, 24 and ADSL architecture 22, 28 may also be combined with, for example, user networks 32*a*, 32*b*. As illustrated in FIG. 14, users may access or use or participate in the administration, management computer assisted program 17–19 in the computer 16 via various different access methods. In this embodiment the various databases 12–15 are only accessible via access to and/or by computer system 16.

In addition to the crossword aspect of the game, the present invention also can optionally incorporate one or more of the following optional elements and features:

1 . . . SPELLING !!!!: The contestant cannot only verbalize the answer, he must optionally also SPELL IT CORRECTLY!!!!!!! If he cannot spell it, he misses the question.

2 . . . "STRATEGY": The contestant can "Pass" or "Play" any clue that he feels is too difficult for him to answer, or that he doesn't think the next person can answer. He can optionally "pass" the responsibility to another player, forcing an opponent to answer, ("DOUBLE CROSSING"), and thus possibly "subtracting" that amount from his opponent's total.

Or the contestant can purposely pick a difficult clue with the intention of passing it on to someone else. However, his strategy might backfire, because if the "Double Crossed" contestant answers correctly, then he will be rewarded, for example, TRIPLE the word amount for being "Double Crossed" and surviving.

3 . . . "CONCENTRATION": The contestants must concentrate and remember what clues were missed. If a clue is not answered correctly, the other contestants may remember that clue and choose it when the amounts are doubled, as the puzzle words never change until the game is over.

4 . . . "SCRABBLE THEME": You have to use one word to connect or complete another word, and you have "double" crosswords, and "bonus" crosswords spread through-out the board.

5 . . . UP WORDS & SIDE WORDS: The present invention features a very different and unique type of crossword, and optionally includes "up" words read from "the bottom up", and across words read from "right to left".

6 . . . AUDIENCE INTERACTION: Optionally, the home audience can also participate by our web site, or calling in and participating during the "Ultimate Double Cross™" round.

7 . . . AMATEUR PUZZLES: The present invention optionally features puzzles from amateur puzzle makers selected from entries submitted from our TV audience.

Incorporating one or more of these exciting aspects in one game, makes "Double Cross™" unique, entertaining, easy to play and fun to watch. When the average person at home watches "Double Cross™" they can easily play along and join in on the fun, and they don't have to be a scholar or an expert.

And with over 50 MILLION people doing standard crossword puzzles every day, it is easily the most popular puzzle played on the planet.

Example of General Play

See FIGS. 12 and 13 for the puzzle solution and the corresponding clue set to which this and the following examples refer.

1 . . . To "kick" start the game, a person from the studio audience is chosen to spin a wheel with vowels on it. When a vowel is chosen, wherever that vowel appears through-out the puzzle board, the cube will light up and that vowel will be added to the board. Other methods of selecting a vowel may also be used, or optionally vowels may be pre-selected.

2 . . . The first contestant will choose a clue (e.g. 5 across ), the host will read the clue, and he or she will have a set amount of time to give the answer. If he is correct, he will be rewarded $25.00 for each letter, (e. g. if the word has four (4) letters he will receive $100.00 to his total), and he will continue to ask for clues. Optionally, the contestant may only be required to specify a specific letter for a cube or word or combination thereof.

However, if he is incorrect, he will lose his control of the board, be penalized that amount, and the other contestants can then "ring in" to answer that clue. If no one rings to answer that clue, then the control of the board goes to the very next player. She will then choose her own clue. If the next player gives a successful answer, she can continue to pick clues until she misses. For example:

Host: Contestant #1 please choose a clue.

#1: I'll take #5 Across.

(Alternate method to begin play: The first contestant or Host could hit a button that sets a lighted cube in motion stopping on a randomly selected clue to start the game.)

[Board][#5 Across has 4 letters, so four cubes light up in White, from left to right in sequence. This clue is worth $100.00 for a correct answer.]

Host: "1922's Valentino's Blood and _____"

#1: Sand?

Host: That's correct, choose again. [Contestant has $100 added to his total.]

The game proceeds this way until a contestant optionally chooses a "Video" clue. These clues will appear on the video screen as either video clips, still shots, or sound bytes, and relate to that day's "Theme", e.g., if the theme is movies, the clues will contain either movie clips, or still shots, or sound bytes of a movie, and we may ask for the director's name or location, or the movie's star, etc.

First Example of the "Double Cross" Play

For this example, we will assume that the first contestant (#1) chooses a "Video clue:"

#1: I'll take #20 Across.

[Board] [Video Clue!!!!!, Video Clue!!!!!, Since this is one of the "Video Clues", the center screen 2 flashes the words "Video Clue", sound effects go off, and the entire word (7 letters) lights up the board in "Bright Green" in sequence from left to right.]

Host: This a video clue, do you want to pass or play?

#1: I'll "double cross" #3 and pass it to him. [#1 passes to #3 because #3 is ahead of him on points, and #1 hopes that #3 misses and loses double the word value from his score. Strategically, #1 could choose any clue that he thinks difficult, just to pass it to #3.]

[Note: #3 has to take this clue and attempt to answer. If he misses, then he will lose $350: $25.00×7 letters =$175.00× double the amount =$350. Other amounts which #3 loses may also be used, or optionally #3 does not lose points, but also does not gain points.]

[Board] [Since this a "Video Clue", the contestants are directed to the center of the puzzle board 1 where the video screen 2 will show a "Clip" of the movie that is part of the puzzle solution.]

Host: #3 you've been "Double Crossed", so you have to take this clue. This movie was made in 1996, you have ten seconds.

#3: Answer: "Michael"

Host: That's correct. This word has 7 letters so it's worth $175.00, and since this is a "Video Clue", all values are doubled, however since you (#3) were "Double Crossed" and successfully answered the question passed to you, you are awarded Triple the value which is $525.00, you may choose again. [Note, If not correct, the contestant is penalized the $350, double value. Other awards or penalties may be used.]

Second Example of the "Double Cross" Play

At the start of the game each player has one "Double Cross™" card. This card will enable them to challenge another player to answer a clue. If they use their card to make a "Double Cross Challenge", and the challenged player guesses and spells the answer correctly, then he keeps ALL OF THE CHALLENGER'S MONEY or other award.

However if the challenged player fails to answer the "Double Cross Challenge", then the challenger GETS TO KEEP ALL OF THE CHALLENGED PLAYER'S MONEY !!!! For example:

Host: Contestant #1, please choose a clue.

#1 I'll take 32 Across.

[Board] [#32 Across has 5 letters, so 5 cubes light up in White from left to right in sequence. (For our example, we will use a "Millionaire" scenario, where each cube on the board is worth $5,000, 200 cubes×$5,000=1 million dollars). Therefore, this clue is worth $25,000.]

Host: "Biz Big Wig"

#1: I'll use my "DOUBLE CROSS™" card and challenge #3 to answer this one. [#1 has only $50,000 in his total, and challenges #3, because #3 is well ahead with $350,000, and #1 hopes that #3 misses and loses all of his money to #1. Strategically, #1 could choose any clue that he thinks is difficult for #3, just to challenge #3.]

Host: #3, you have been issued a "Double Cross Challenge∞, so you must answer the challenge, what is your answer?

#3: My answer is Mogul. M-O-G-U-L.

Host: That's correct, you have won the $25,000 for the correct answer, but because you have beaten #1's challenge and answered the question correctly, YOU HAVE ALSO WON ALL OF #1'S. MONEY. Adding #1's $50,000 to this word's total of $25,000, you now add $75,000 to your total! And #1, because #3 has answered your challenge correctly, you have lost all your money, and must now start from zero!!!

[Note: If #3 had not answered and spelled correctly, then #1 would have catapulted himself into 1st place with #3's $350,000. #3 then would have nothing.]

Example of a Bonus Clue

During the course of the game, a contestant may pick a "Bonus Clue", and win both money and prizes.

#2: I'll choose #9 Down.

[Board] [Bonus Clue!!! Bonus Clue!!! Since this is one of the bonus clues, the center screen flashes the words "Bonus Clue", sound effects go off, and the entire word (5 letters) optionally lights up the board in "Bright Red" in sequence from top to bottom.]

Host: This a "Bonus Clue", you can wager up to $100.00 per letter, and if you answer correctly, you can also win this great prize.

#2: I'll wager $100 per letter.

Host: Made crow sounds.

#2: Cawed.

Host: That's correct, that will add $500 to your score. Choose again.

The game continues this way until the half way mark. When the second half begins, all letter values are optionally doubled. The specific sequence of the above steps may be altered. For example, the clue might be presented to the contestant prior to the wager.

First Example of Game's Final Phase

At the conclusion of the game, and located in the center of the board, several cubes will interlock and light up, forming the two (2) final questions in "ULTIMATE DOUBLE CROSS™". The "Ultimate Double Cross™"

answers will optionally be directly related to the clues of the puzzle. For example, in the sample puzzle shown in FIG. 7, the "Theme" would be "MOVIES", and there are six movie titles located within the puzzle which would be "Video Clues:"

#20 Across="Michael"
#22 Across="Face off"
#36 Across="Carrie"
#37 Across="Grease"
#50 Across="Perfect"
#53 Across="Blowout"

With this in mind, the "Ultimate Double Cross™" segment begins with the contestant (or top contestants) that has the largest total at the end of regulation, spinning the wheel for the "bonus" letters. When the letters have been inserted into the puzzles, the segment can begin.

Once the Host reads the clue, he will have 30 seconds to solve the first crossword. If he is successful, he can quit (Pass) take the prize, and stop there. Or he can continue on (Play), and risk everything on the double crossword. If he successfully answers both clues, he wins everything, but if he misses the second question, he loses everything. For example, we will assume that contestant #2 had the highest total, and won the game:

[Board] [Cubes light up to form two interlocking answers.]
[#2:] [Spins the wheel for letters to be added to the puzzle.]
[Board] [The chosen letters fill in the cubes where they appear.]
Host: Contestant #2, you will have 30 seconds to answer this clue: "I starred in all of those movies, who am I?"
#2: Answer: John Travolta
Host: You are correct, and you have won $10,000, do you "Pass" and keep the money, or "Play" for $15,000 more. [Note: if he plays and misses, he optionally loses the $10,000; if he stops now he keeps the $10,000.]
#2: I'll play!
Host: Here is your second question, you have 30 seconds to answer, "I was his 'Greasy' co-star, and we share the same name, who am I?"
#2: Answer: Olivia Newton John
Host: You are correct, and you've won $25,000 !!!!!!!!
The game concludes with the board flashing and with the theme music playing.

Second Example of Game's Final Phase

All three contestants will be allowed to play "Ultimate Double Cross™". They can wager whatever amount they choose from their totals, and there will be two interlocking words forming the final puzzle.

They would be asked the first question and given thirty seconds to answer it. Their answers will be optionally written on the monitors at their podiums, they will be checked, and the amounts awarded. The contestants will have a chance to "pass" and keep the amount awarded, or "play," and solve the second puzzle. At the end of the second puzzle, the contestant with the largest amount wins $25,000, or whatever amount we decide to award.

Third Example of Game's Final Phase

The player with the most money at the end of regulation "DOUBLE CROSS™", must wager ALL OF HIS WINNINGS ON THE FIRST "FINAL DOUBLE CROSS™" CLUE. If he is successful, he can either take his money and stop, or he can elect to play, "DOUBLING" his total. If he misses at any time, he loses everything. For example:

Host: Contestant #3, you have won the regular round, and are about to play "FINAL DOUBLE CROSS™".
[Board] [Clues light up forming two interlocking puzzles.]
[#3:] [Spins the wheel for vowels to be added to the puzzle.]
[Board] [The chosen vowels fill the two interlocking words wherever they appear.]
Host: Contestant #3, since you finished the regular round as our winner with $350,000, you realize that you must wager all of your total on this first of two puzzles. You will have 30 seconds to answer this clue: "I starred in all of those movies, who am I?"
#3: Answer: "John Travolta"
Host: You are correct, and you have doubled your money, you now have $700,000. Do you want to pass and keep your money or double it again?
#3: I'll play!!!!
Host: All right then, here is your second clue for $1,500,000; you have 30 seconds to answer. "I was his "greasy" co-star, and we share the same name, who am I???"
#3 Answer: "Olivia Newton John"
Host: You are correct, you have just won One Million Five Hundred Thousand Dollars!!!!!!!
The game concludes with lights flashing, fake dollar bills falling, the theme song playing and the audience cheering.

While the invention has been described in connection with specific and preferred embodiments thereof, it is capable of further modifications without departing from the spirit and scope of the invention. This application is intended to cover all variations, uses, or adaptations of the invention, following, in general, the principles of the invention and including such departures from the present disclosure as come within known or customary practice within the art to which the invention pertains, or as are obvious to persons skilled in the art, at the time the departure is made. It should be appreciated that the scope of this invention is not limited to the detailed description of the invention hereinabove, which is intended merely to be illustrative, but rather comprehends the subject matter defined by the following claims.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. In a modified crossword puzzle gameshow, including a game board having a plurality of shapes substantially defining a plurality of columns and a plurality of rows intersecting and formed thereby, each of the shapes accommodating at least one of at least one letter and at least one word, the modified crossword puzzle game further including at least one clue associated with, and optionally providing at least partial information regarding the at least one of the at least one letter and the at least one word, a method of playing the modified crossword puzzle game with a plurality of players at least including first and second players, comprising the steps of:

(a) presenting the at least one clue to at least one of the first and second players associated with and optionally providing the at least partial information regarding the at least one of the at least one letter and the at least one word;

(b) responding, by the at least one of the first and second players, to the at least one clue presented in said presenting step (a);

(c) determining whether the response by the at least one of the first and second players provided in said responding step (b) is at least substantially correct;

(d) when the at least one of the first and second players is at least substantially correct as determined in said determining step (c), revealing the at least one of the at least one letter and the at least one word accommodated by at least a first section of the plurality of shapes, and rewarding the at least one of the first and second players, and when the at least one of the first and second players is at least substantially incorrect, providing another of the first and second players with the option of responding to the at least one clue or being presented with at least another clue; and (e) repeating said steps (a)–(d) for each of the first and second players in accordance with predetermined criteria until at least substantially all of the plurality of shapes substantially defining the plurality of columns and plurality of rows are revealed, thereby at least substantially solving the modified crossword puzzle game, wherein said responding step (b) optionally includes the step of the at least one of the first and second players choosing to guess the at least one letter or at least one word associated with the at least one clue and accommodated by the at least one or choosing to "double cross" another of the first and second players thereby challenging the other at least one of the first and second players to guess the at least one letter and at least one word.

2. A method according to claim 1, wherein the at least one clue presented to at least one of the first and second players provides specific information about the at least one letter and at least word to be accommodated by the shape associated with the at least one clue.

3. A method according to claim 1, wherein said presenting step (a) optionally includes the step of randomly determining the at least one clue to be presented to the at least one of the first and second players, or optionally includes the step of allowing the at least one of the first and second players to choose the at least one clue.

4. A method according to claim 1, wherein the modified crossword puzzle game begins by any method being used to choose at least one letter to be revealed in all of the shapes accommodating the at least one letter.

5. A method according to claim 1, wherein the game board optionally further includes a video screen, said video screen placed in the center of the game board, such that the outer edges of said video screen form the internal edge of the game board.

6. A method according to claim 5, wherein the at least one clue optionally includes a "video clue," the video clue comprising a clue including the element of a visual image, said visual image optionally displayed on the video screen.

7. A method according to claim 5, wherein the video screen may be used to perform optionally one or more of the following:

display a selected clue; or display a video clue; or display the Double Cross™ game logo; or display the logo of the phase of the game that is being played; or display any other visual image.

8. A method according to claim 1, wherein said at least one clue optionally consists of a "bonus clue," the bonus clue comprising a clue, such that the bonus clue being answered correctly by the at least one of the first and second players results in rewarding step (d) including a reward for the at least one of the first and second players that is greater than the usual amount or that includes a special reward.

9. A method, according to claim 1, wherein the determining step (c) includes requiring the one of the at least first and second players to spell the answer correctly in order to determine whether the response is at least substantially correct.

10. A method, according to claim 1, wherein after a certain point in the modified crossword puzzle game the amounts awarded under rewarding step (d) when the at least one of the first and second players is at least substantially correct as determined in determining step (c) are increased by a uniform amount or by a uniform factor.

11. A method, according to claim 10, wherein the at least first and second players may optionally strategize to concentrate on remembering what clues were incorrectly answered, in order strategically to choose the incorrectly answered clues that they think they can answer correctly when award amounts are increased.

12. A method, according to claim 1, wherein the presenting step (a) optionally requires that at least one letter of the at least one letter and at least one word has been previously revealed according to revealing step (d).

13. A method, according to claim 1, wherein at least one of the plurality of shapes accommodating at least one of at least one letter and at least one word accommodates at least one letter or at least one word such that the amounts awarded under rewarding step (d) when the at least one of the first and second players is at least substantially correct as determined in determining step (c) are increased by a uniform amount or by a uniform factor.

14. A method, according to claim 1, wherein the revealing step (c) may optionally include revealing at least one word that is accommodated in a vertically ascending plurality of shapes, and may optionally include revealing at least one word that is accommodated in a horizontal right-to-left plurality of shapes.

15. A method, according to claim 1, wherein the modified crossword puzzle game includes a crossword puzzle game selected from at least one entry submitted by at least one amateur crossword puzzle maker from the modified crossword puzzle game's television audience.

16. A method, according to claim 1, wherein the plurality of players at least including first and second players may optionally also include at least one player participating in the game via any telecommunications technology or any combination of telecommunications technologies, including telephone, facsimile machine, cable modem or any internet technology.

17. In a modified crossword puzzle gameshow, including a game board having a plurality of shapes substantially defining a plurality of columns and a plurality of rows intersecting and formed thereby, each of the shapes accommodating at least one of at least one letter and at least one word, the modified crossword puzzle game further including at least one clue associated with, and optionally providing at least partial information regarding the at least one of the at least one letter and the at least one word, a method of playing the modified crossword puzzle game with a plurality of players at least including first and second players, comprising the steps of:

(a) presenting the at least one clue to at least one of the first and second players associated with and optionally providing the at least partial information regarding the at least one of the at least one letter and the at least one word;

(b) responding, by the at least one of the first and second players, to the at least one clue presented in said presenting step (a);

(c) determining whether the response by the at least one of the first and second players provided in said responding step (b) is at least substantially correct;

(d) when the at least one of the first and second players is at least substantially correct as determined in said determining step (c), revealing the at least one of the at least one letter and the at least one word accommodated by at least a first section of the plurality of shapes, and rewarding the at least one of the first and second players, and when the at least one of the first and second players is at least substantially incorrect, providing another of the first and second players with the option of responding to the at least one clue or being presented with at least another clue; and (e) repeating said steps (a)–(d) for each of the first and second players in accordance with predetermined criteria until at least substantially all of the plurality of shapes substantially defining the plurality of columns and plurality of rows are revealed, thereby at least substantially solving the modified crossword puzzle game, wherein said responding step (b) optionally includes the step of the at least one of the first and second players choosing to guess the at least one letter or at least one word associated with the at least one clue and accommodated by the at least one or choosing to "double cross" another of the first and second players thereby challenging the other at least one of the first and second players to guess the at least one letter and at least one word, wherein each one of the at least first and second players has only one or a limited number of chances to "double cross" another of the at least first and second players, and each one of the at least one first and second players optionally receives only one or a limited number of playing cards labeled with the words "Double Cross," and each one of the at least one first and second players choosing to "double cross" optionally must discard one of the one or a limited number of playing cards labeled with the words "Double Cross", and each one of the at least first and second players optionally strategizes in order to decide on which responding step (b) they will "double cross" another of the at least first and second players and discard one of the one or a limited number of playing cards labeled with the words "Double Cross."

18. In a modified crossword puzzle gameshow, including a game board having a plurality of shapes substantially defining a plurality of columns and a plurality of rows intersecting and formed thereby, each of the shapes accommodating at least one of at least one letter and at least one word, the modified crossword puzzle game further including at least one clue associated with, and optionally providing at least partial information regarding the at least one of the at least one letter and the at least one word, a method of playing the modified crossword puzzle game with a plurality of players at least including first and second players, comprising the steps of:

(a) presenting the at least one clue to at least one of the first and second players associated with and optionally providing the at least partial information regarding the at least one of the at least one letter and the at least one word;

(b) responding, by the at least one of the first and second players, to the at least one clue presented in said presenting step (a);

(c) determining whether the response by the at least one of the first and second players provided in said responding step (b) is at least substantially correct;

(d) when the at least one of the first and second players is at least substantially correct as determined in said determining step (c), revealing the at least one of the at least one letter and the at least one word accommodated by at least a first section of the plurality of shapes, and rewarding the at least one of the first and second players, and when the at least one of the first and second players is at least substantially incorrect, providing another of the first and second players with the option of responding to the at least one clue or being presented with at least another clue; and (e) repeating said steps (a)–(d) for each of the first and second players in accordance with predetermined criteria until at least substantially all of the plurality of shapes substantially defining the plurality of columns and plurality of rows are revealed, thereby at least substantially solving the modified crossword puzzle game, wherein said responding step (b) optionally includes the step of the at least one of the first and second players choosing to guess the at least one letter or at least one word associated with the at least one clue and accommodated by the at least one or choosing to "double cross" another of the first and second players thereby challenging the other at least one of the first and second players to guess the at least one letter and at least one word, wherein one of the at least first and second players who chooses to "double cross" another of the at least first and second players optionally may take some portion of or all of the points accumulated by the other of the at least first and second players when the other player guesses incorrectly and add the portion of or all of the points to the one of the at least first and second players' accumulation of points, and one of the at least first and second players who is "double crossed" by another of the at least first and second players optionally may take some portion of or all of the points accumulated by the other of the at least first and second players when the one of the at least first and second players guesses correctly, and add the portion of or all of the points to the one of the at least first and second players' accumulation of points.

* * * * *